United States Patent [19]

Anderson et al.

[11] 3,962,901

[45] June 15, 1976

[54] ELECTRICAL CONNECTOR TAP ASSEMBLY APPARATUS

[75] Inventors: Leslie Alan Anderson; Carmen Achille Cea; John Maury Gentry, all of Winston-Salem, N.C.

[73] Assignee: AMP Incorporated, Harrisburg, Pa.

[22] Filed: July 23, 1975

[21] Appl. No.: 598,520

Related U.S. Application Data

[62] Division of Ser. No. 399,035, Sept. 20, 1973.

[52] U.S. Cl. ..... 72/410; 29/203 H; 29/628; 140/121; 174/84 C

[51] Int. Cl.[2] ..... H01R 43/00; B21D 9/08

[58] Field of Search ..... 72/410, 409, 400, 331; 29/280, 282, 628, 203 H, 203 HM; 174/84; 7/5.6, 14.1; 140/121

[56] References Cited

UNITED STATES PATENTS

| | | | |
|---|---|---|---|
| 3,239,918 | 3/1966 | Cobaugh | 29/203 HM |
| 3,328,871 | 7/1967 | Over | 29/280 |
| 3,328,872 | 7/1967 | Reem | 140/121 |
| 3,393,438 | 7/1968 | Marley | 72/410 |
| 3,426,355 | 2/1969 | Over | 72/409 |
| 3,436,820 | 4/1969 | Reem | 72/410 |
| 3,443,299 | 5/1969 | Brown | 72/409 |
| 3,571,890 | 3/1971 | Brehm | 72/410 |
| 3,639,977 | 2/1972 | Over | 29/628 |
| 3,767,841 | 10/1973 | Anderson | 29/628 |

*Primary Examiner*—C. W. Lanham
*Assistant Examiner*—Gene P. Crosby
*Attorney, Agent, or Firm*—Robert W. Pitts; Frederick W. Raring; Jay L. Seitchik

[57] ABSTRACT

A tool for use in connecting two conductors by crimping a pre-insulated open-U shaped connecting device simultaneously around separate conductors is disclosed. The tool is adapted for trimming either or both wires and can attach the connecting device to a through wire so that a tap connection can be formed. The through wire extends out of the center of the connecting device and the tool forms the insulation around the through wire to establish a suitable dielectric.

9 Claims, 14 Drawing Figures

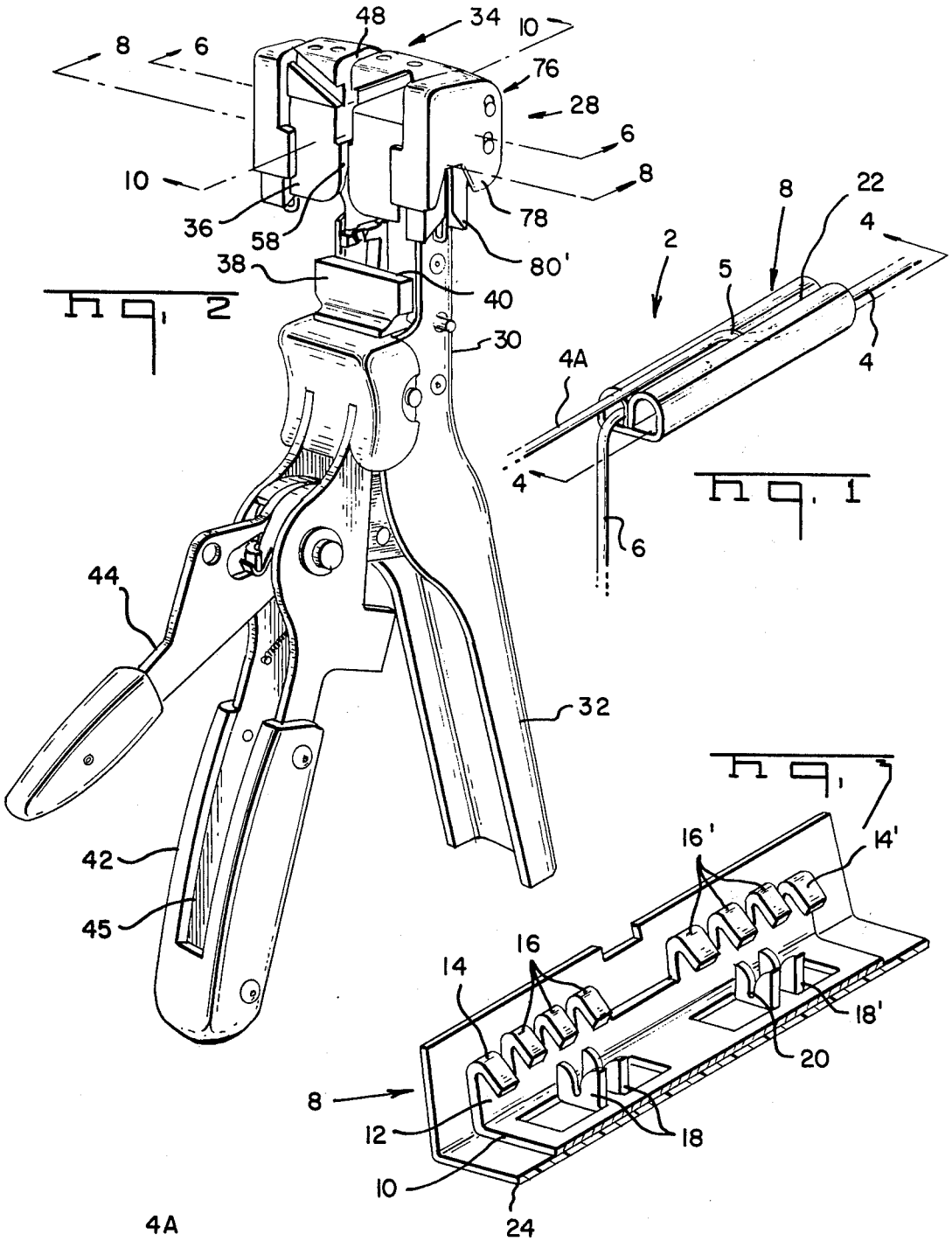
Fig. 2
Fig. 1
Fig. 3
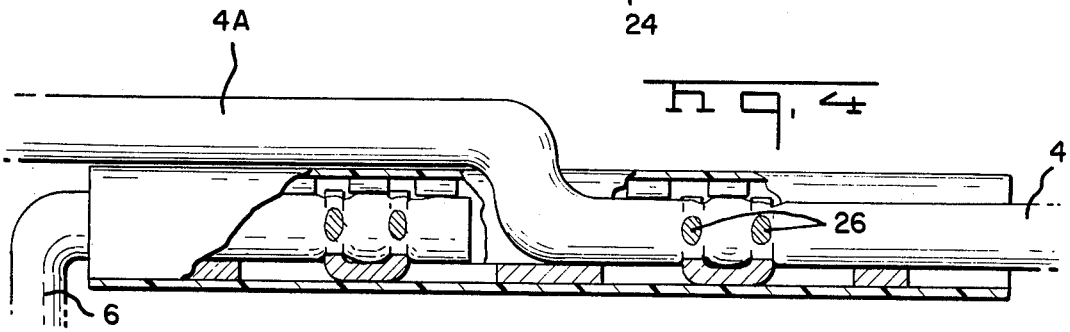
Fig. 4

ELECTRICAL CONNECTOR TAP ASSEMBLY APPARATUS

This is a divisional application of pending prior application Ser. No. 399,035 filed on Sept. 20, 1973.

BACKGROUND OF THE INVENTION

A widely used open-U type of connecting device for connecting the ends of two wires to each other is disclosed in U.S. Pat. Nos. 3,328,872 and 3,328,871 along with suitable tools for crimping these open U-connecting devices onto the wires. The tools shown in these patents have means for trimming the ends of the wires at the time of crimping so that the wires can be positioned in the tool and trimmed to the desired length at the same time the connecting device is crimped onto the trimmed ends. Connecting devices and tools of the types shown in the foregoing patents are widely used in the telephone industry for connecting the ends of wires in multi-conductor telephone cables.

It is also necessary in the telephone arts to form tap connections under some circumstances, that is, to connect the end of one wire to an intermediate portion of another wire and the connecting devices shown in U.S. Pat. Nos. 3,328,872 and 3,328,871 can also be used for making tap-type connections. In a tap connection as disclosed in these patents, the through wire extends continuously through the crimped conecting device and the tap wire extends into the connecting device at one end thereof and the end of the tap wire is disposed within the crimped connecting device.

Application Ser. No. 274,931, now U.S. Pat. No. 3,767,841 discloses and claims an improved connecting device for making telephone cable splices which is considerably smaller than the connecting device shown in the previously identified U.S. Pat. Nos. 3,328,871 and 3,328,872. This, newer type of connecting device is adapted to receive only one wire at each end thereof and is particularly intended for making splicing connections rather than tap-type connections. Connecting devices as shown in application Ser. No. 274,931 are highly desirable because of their reduced size as compared with previously open U-type connecting devices and for certain other reasons although they have previously been used only for making splice connections and were thought to be incapable of being used for tap-type connections.

We have found that, in fact, tap-type connections can be made with connecting devices of the type shown in U.S. Pat. No. 3,767,841 and further that two parallel wires can be connected intermediate their ends with these more recent connecting devices. The connecting device is crimped onto the wires by a crimping tool which is similar in many respects to the tool shown in U.S. Pat. No. 3,318,871 but which incorporates certain changes which permit the achievement of tap-type and splice-type electrical connections at the option of the technician.

The crimping tool disclosed and claimed herein incorporates a movable anvil and shear bar which is similar to that disclosed in U.S. Patent 3,767,841. This patent shows the deformation of a connecting device to form a suitable electrical connection and the same principle is employed with the instant crimping tool. The head and the shear bar have been significantly modified, however. These modifications enable the operator to lace separate wires into the tool so that each wire may be cut and crimped at the cut end or only crimped at an intermediate point without cutting.

This permits the formation of a tap connection with a through wire. It will be apparent that the cutting and crimping of one wire is simultaneous but independent of the cutting and crimping of the other wire. Therefore, either or both of these wires may be a through wire and in fact, this tool can still be used to form a conventional end to end splice.

It is accordingly an object of the invention to provide an improved tap-type electrical connection. It is a further object to provide a compact tap-type electrical connection by means of a connecting device which can be used for either tap-type or splice type connections. A further object is to provide an improved crimping tool which can be used to crimp an open U-type connecting devices onto two wires to form either a tap-type or a splice-type connection or to connect two wires intermediate the ends thereof.

These and other objects of the invention are achieved in preferred embodiments thereof which are briefly described in the foregoing abstract, which are described in detail below and which are shown in the accompanying drawing in which:

FIG. 1 is a perspective view of a tap-type electrical connection in accordance with the invention.

FIG. 2 is a perspective view of a crimping tool which is adapted to crimp a connecting device of the type shown in FIG. 3 to form either a splice connection or the tap-type connection of the type shown in FIG. 1.

FIG. 3 is a sectional perspective view of an electrical connecting device which can be used in the practice of the invention.

FIG. 4 is a view taken along the lines 4—4 of FIG. 1.

Figure 5:
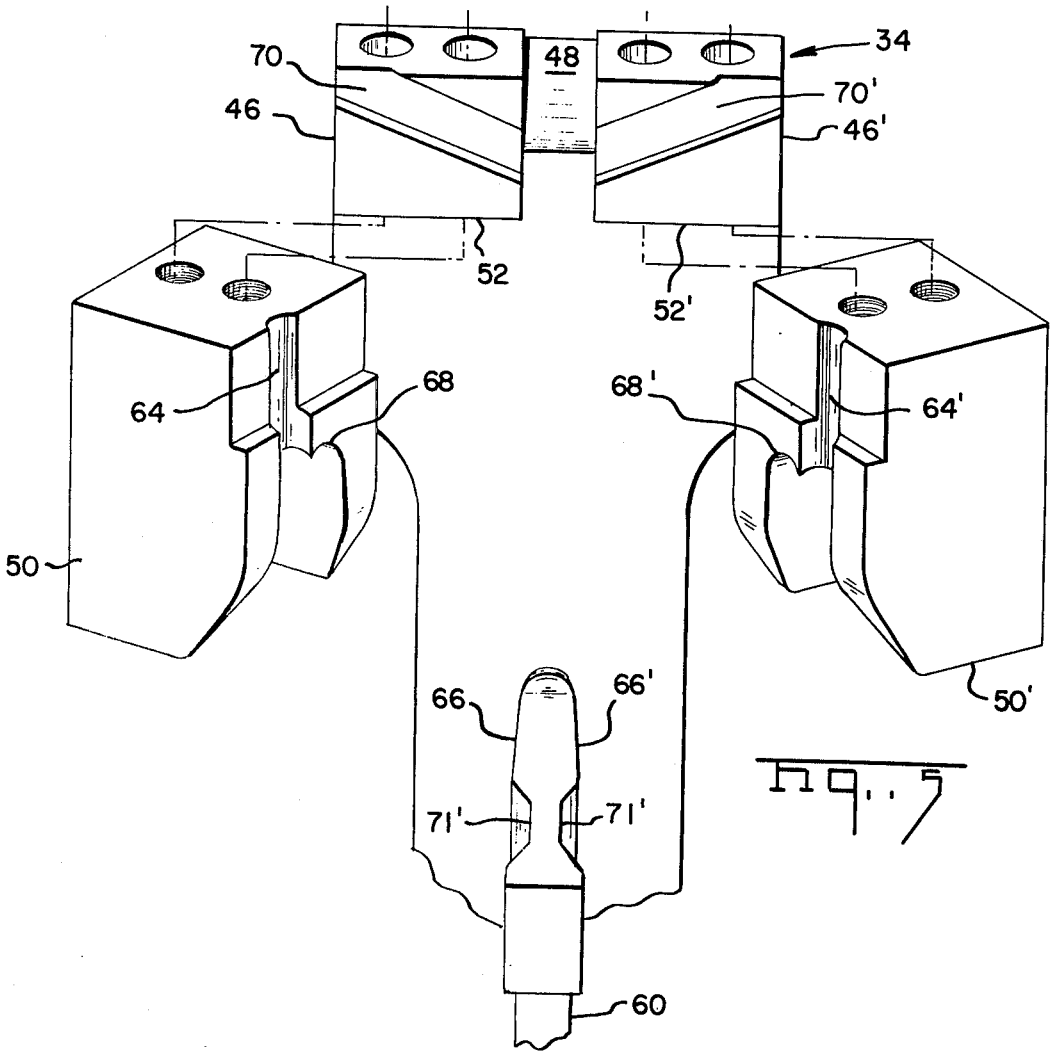
FIG. 5 is a fragmentary frontal view of the head portion of the tool of FIG. 1 with the crimping die blocks exploded therefrom.

Referring first to FIGS. 1–4, a tap-type electrical connection 2 in accordance with the invention between a through wire 4 and a tap wire 6 comprises a crimped electrical connecting device 8 which is open at each end and which has an axial seam 22 extending between the open ends. The through wire 4 extends into one end of the connecting device, partly through the connecting device, and emerges from the open seam as shown at 5 and extends externally from the connecting device as shown at 4A. The tap wire 6 extends into the other end of the connecting device and the end of the tap wire is contained in the crimped connecting device.

Prior to crimping, the connecting device is generally U-shaped having a web 10 and relatively low sidewalls 12 extending from the sides of the web. Each sidewall has a plurality of fingers integral therewith which are curved inwardly and towards the web as shown at 14, 16, 14', 16'. Lances 18, 18' are struck up from the web and have wire receiving slots 20 therein of a width such that when a wire is forced into these slots, the insulation of the wire will be penetrated and electrical contact will be established with the conducting core of the wire as shown at 26, FIG. 4. An insulating film 24 of tough plastic material is bonded to the external surface of the connecting device so that when it is crimped, and the sidewalls are bent inwardly and towards the web 10, this film will be tucked into the seam as also shown in FIG. 1.

As is apparent from FIG. 4, in the crimped connection, the through wire 4 is electrically connected to the tap wire 6 by virtue of the fact that the through wire is disposed in the slots in the lances 18', and the tap wire is in the slots in the lances 18. The crimped connection of FIGS. 1 and 4 is achieved by means of a crimping tool shown in FIGS. 2 and 5–12 which is described immediately below.

The tool 28 shown is of the general type described in detail in the above-identified U.S. Pat. No. 3,328,871 but with certain modifications and changes to the crimping die thereof as described in detail below. The general features of the tool are described only briefly and to the extent necessary for an understanding of the instant invention and reference is made to U.S. Pat. No. 3,328,871 for a description of a specific structural features such as the linkage of the tool.

The tool comprises a frame generally indicated at 30 from which a fixed handle 32 extends and from which a head 34 extends upwardly. The head has a forwardly projecting flange at its upper end and die means generally indicated at 35 are mounted against the underside of this flange. A movable anvil 38 is provided having an upper surface 40 on which the connecting device 8 is mounted during the crimping operation, this anvil being reciprocated between open and closed positions by a suitable linkage described in the above-identified U.S. Pat. No. 3,328,871. The linkage is actuated by two movable handles 42, 44, the arrangement being such that when the handle 44 is swung counterclockwise from the position shown in FIG. 2 and into the recess 45 in the handle 42, the anvil is moved through a substantial portion of its stroke towards the die means. Both handles 44, 42 are then swung in unison towards the handle 32 to drive the anvil through the final portion in its upward stroke. It is during this final portion of the stroke that the highest crimping forces are required and the linkage provides a high mechanical advantage so that the operator can develop the necessary thrust without undue effort.

Turning now to FIGS. 5–12, the forwardly extending flange 46,46' of the tool head has a centrally located transversely extending slot 48 extending inwardly from the front side thereof. The die means comprises two die blocks 50, 50' which are substantial mirror images of each other and these die blocks are secured by suitable fastening means to the downwardly facing surfaces 52, 52' of the flange on each side of the slot 48. The die blocks are spaced apart so that a relatively narrow slot is left between them as shown at 58 (FIG. 1) which is in alignment with the previously identified slot 48. As shown best in FIG. 10, the downwardly facing sides of each die block have a trough-like recess having inwardly curved sides **52, 52*a* which are reversely curved at 54, 54*a* and which intersect to form a cusp 56. These surfaces serve as forming surfaces which curl the fingers 14, 16, 14', 16' and the sidewalls 12** of the connecting device inwardly and towards the web of the connecting device during the crimping.

Figure 12:
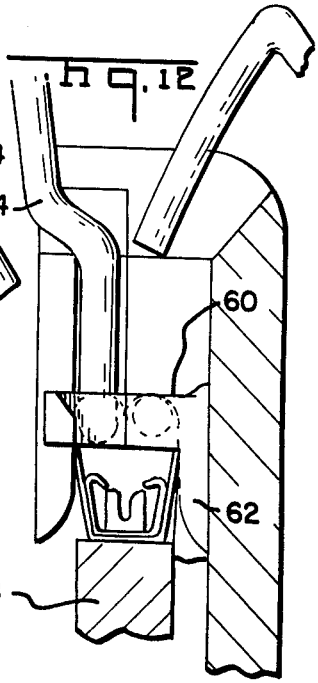
FIG. 12 is similar to FIG. 11 but showing positions of the parts immediately prior to the conclusion of the crimping operation.

A forwardly extending cutter bar 60 is provided between the die and anvil and is dimensioned to have a close sliding fit in the slot 58 between the two die blocks. Cutter bar 60 has a depending leg 62 by means of which it is connected to the anvil so that when the anvil moves upwardly from the position of FIG. 1, the cutter bar moves into the slot 58 in advance of the anvil as shown in FIG. 12 and as fully described in U.S. Pat. No. 3,328,871.

Shallow grooves 64, 64' are provided on the opposed surfaces of the die blocks 50, 50' and on the forward side of the cusps as shown best in FIG. 5 and shallow recesses 71, 71' are provided on the sides of the cutter bar 60. The recesses 71, 71' are located near the forward or free end of the cutter bar so that the recesses will move past and along the grooves as the cutter bar moves upwardly. These grooves and recesses provide clearance for a wire so that the wire is not severed when the cutter bar and anvil move upwardly in the manner described below. The inner portion of the cutter bar has a width such that it is snugly received in the inner portions of the slot 58 so that the upper edges of the cutter bar will cooperate with edges 68, 68' of the opposed faces of the die block to serve as a wire shearing means. It will be apparent that the shearing means is thus provided on the innermost curved portions of the forming surfaces of the die blocks, that is,, behind the cusps of the die blocks.

The forwardly facing surfaces of the flange 46, 46' of the tool head are provided with diagonally extending recesses 70, 70' which extend from the central slot 48. These grooves or recesses provide a means for locating the through wire in the tool when the connector is crimped as will also be described below. It should also be noted, FIG. 11, that the slot 48 extends to the rearward side of the tool head and the inner end of the slot is defined by an inclined surface 73 which defines a relatively sharp edge 74 over which the tap wire is dressed. This sharp edge thus comprises a retaining means which holds the tap wire in position adjacent to the rear of the tool.

Figure 13:
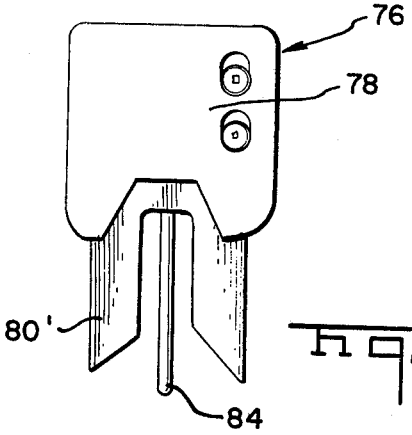
FIG. 13 is a side view of the head portion of the tool of FIG. 2 showing structural features of the wire positioning means which are provided on each side of the head of the tool.

Means are provided on each side of the tool head for locating the wires therein as shown at 76, this locating means comprising a plastic or elastomeric blocks 80, 80' each of which has a slot 82 extending upwardly as viewed in the drawing from its lower edge. A metal pin is fixed in the block and extends downwardly and between the side edges of the slot 82, this pin being in alignment with the cusps 56, 56' so that a wire located on the righthand side of this pin as viewed in FIG. 13 will be proximate to the forming surface 54 of the die block and a wire located on the lefthand side thereof will be proximate to the forming surface 54A. Gripping means are thus formed on both sides of cusps 56, 56'. The plastic blocks 80 are clamped against the outwardly facing side of the tool head and die block by suitable clamping guides 78 as shown best in FIG. 1.

Figure 6:
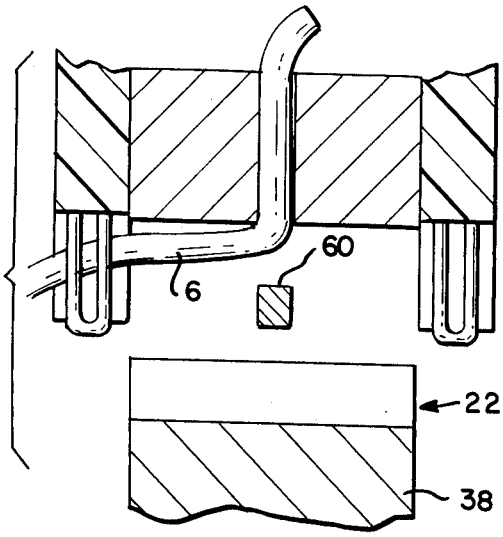
FIG. 6 is a fragmentary sectional view taken along the lines 6—6 of FIG. 1 and showing the manner in which the tap wire is located in the tool when a tap-type connection is being made, this view showing the positions of the parts prior to the crimping operation.
Figure 7:
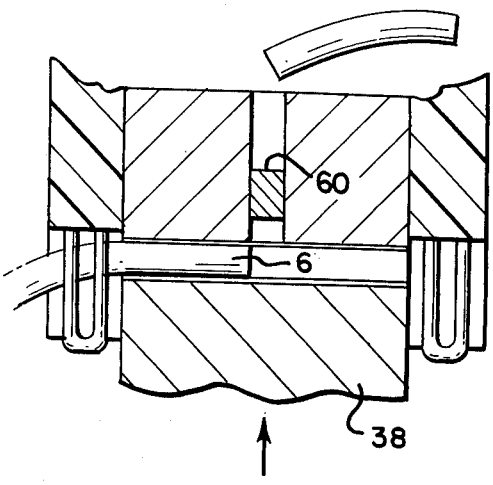
FIG. 7 is a view similar to FIG. 6 but showing the positions of the parts at the conclusion of the crimping operation.
Figure 8:
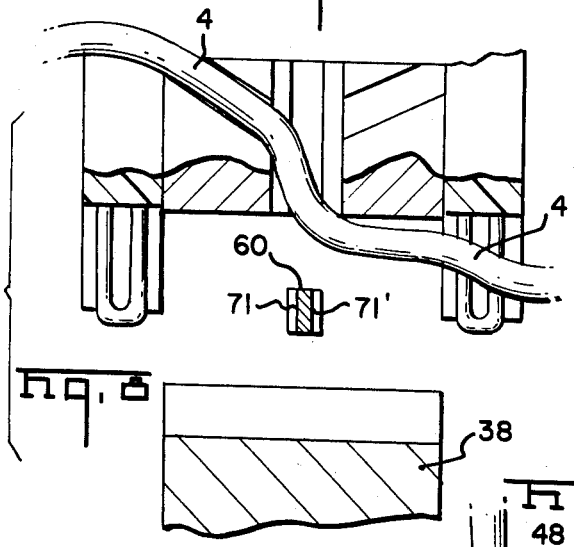
FIG. 8 is a view taken along the lines 8—8 of FIG. 1 showing the manner in which the through wire is positioned in the tool, this view showing the positions of the parts prior to the crimping operation.
Figure 9:
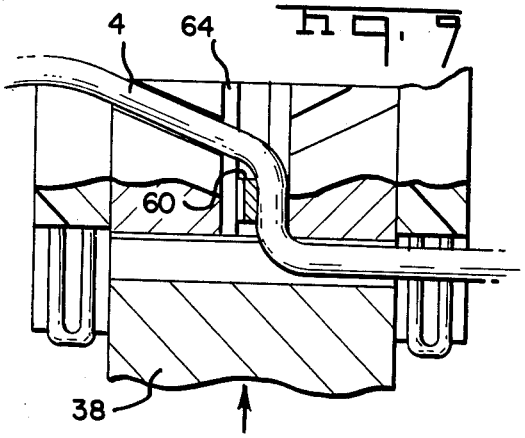
FIG. 9 is a view similar to FIG. 8 but showing the positions of the parts at the completion of the crimping operation.
Figure 10:
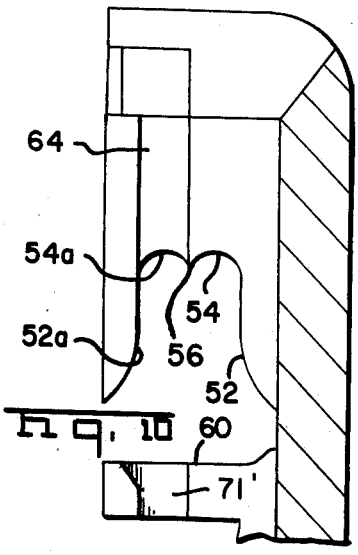
FIG. 10 is a fragmentary view of the head portion of the tool taken along the lines 10—10 of FIG. 2.
Figure 11:
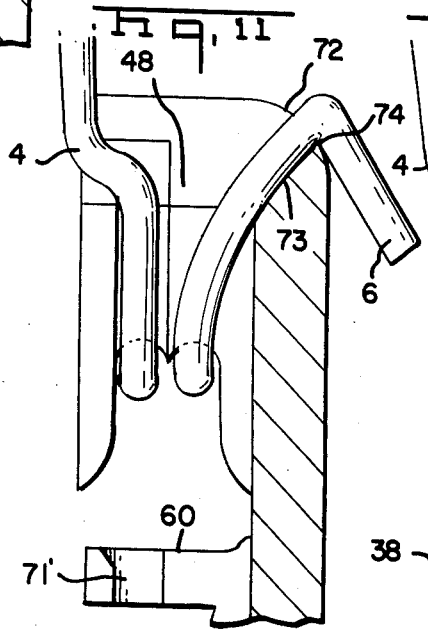
FIG. 11 is a view similar to FIG. 10 illustrating the lacing of the wires through the tool preparatory to making a tap-type connection.

In use, when it is desired to form a tap-type connection as shown in FIG. 1, the tap wire 6, which extends from the left in the drawing is positioned between the die and anvil and on the inner side of the pin 84 of the guide means 76. The end portion of the tap wire is then positioned in the slot 58 and dressed over the edge 74 as shown in FIG. 11. The through wire 4 is positioned between the die block 50' and the anvil and is positioned in the slot 48 in front of the tap wire as shown in FIG. 11 so that it will extend beside the groove 64' of the die block 50'. The tap wire is also located in the grooves 70 of the tool head which guides the wire away from the tool head and temporarily holds it in position while the connector is being crimped. The connecting device is then positioned on the anvil and the handles are closed to move the cutter bar 60 and the anvil upwardly towards the die means. During such upward movement of the cutter bar, the tap wire 6 is trimmed as shown in FIGS. 6 and 7 by the side edges of the rearward portion of the cutter bar with cooperation with the edge portion 68 of the die block 50. The through wire 4, however, is not trimmed as illustrated in FIGS. 8 and 9 for the reason that the recess 64' and the die block 64' and the recess 71' and the cutter bar provide clearance for the wire. After the trimming operation, the anvil moves upwardly from the position of FIG. 12 and the connector is crimped onto the wires. The wires are shifted laterally during the final stages of crimping and located in alignment with the slots 20 of the lances 18, 18' as described more fully in U.S. Pat. No. 3,767,841.

A salient advantage of the invention is that one type of connector which is extremely compact can be used for making tap connections or splice connections. When it is desired to make a splice between two wires rather than a tap, both of the wires are positioned on the inner sides of the dividing pins 84, 84' so that both wires will be sheared when the shearing pin moves upwardly. The technician can thus form splice connections or tap connections with one tool and one type of connecting device.

Figure 14:
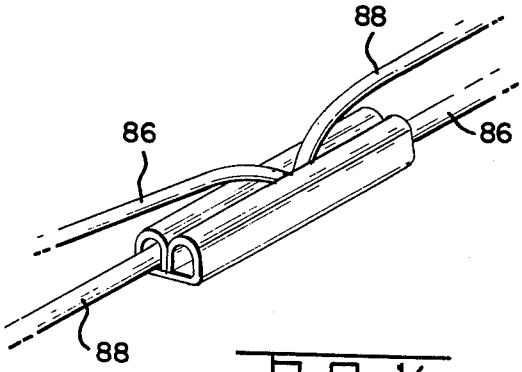
FIG. 14 is a perspective view of an electrical connection between intermediate portions of two through wires.

If desired, two wires 86, 88 can be connected intermediate their ends as shown in FIG. 14 to achieve this type of connection, both wires are positioned in the tool on the front sides of the dividing pins 84 so that neither of the wires will be severed.

It should be added that while the tap wire is shown as extending from the left in FIGS. 6–12 and the through wire from the right through the tool, the wires can be reversed so that the tap wire will extend from the right. The projections of the grooves 64, 64' and recesses 71, 71' on the die blocks and the cutter bar permit either option.

Changes in construction will occur to those skilled in the art and various apparently different modifications and embodiments may be made without departing from the scope of the invention. The matter set forth in the foregoing description and accompanying drawings is offered by way of illustration only.

What is claimed is:

1. In an apparatus for crimping a connecting device onto each of two wires to electrically connect said wires to each other, said connecting device being of the open-U type having sidewalls which are adapted to be formed inwardly towards each other and into surrounding relationship with said wires, said apparatus being of the type comprising crimping die means and crimping anvil means, said die and anvil means being movable relatively towards and away from each other between open and closed positions, said anvil means having a supporting surface for supporting said connecting device with said sidewalls directed generally towards said die means, said die means having forming surface portions which are opposed to said anvil means, said forming surfaces being adapted to form said sidewalls towards each other and into surrounding relationship to wires located between said die and anvil, a wire receiving slot in said die means extending transversely therein and intersecting said forming surface portions whereby wires can be positioned between said die and anvil means and can extend laterally through said slot intermediate the ends of said die means, a wire shearing member positioned between said die and anvil when said die and anvil are in said open position, said shearing member being movable relatively into said slot to shear wires extending into said slot the improvement to said apparatus comprising:

wire clearance means between said shearing member and at least one side of said slot, said clearance means extending generally in the direction of movement of said shearing member into said slot whereby, the said end of one of said wires can be located in said clearance means and said one wire will not be sheared by said shearing member, and upon crimping said open U-type connecting device onto said wires, said wire will extend continuously into the crimped connecting device and will extend from said connecting device intermediate the ends thereof, and the other one of said wires will be severed and have its end within said connecting device to produce a tap-type electrical connection.

2. Apparatus as set forth in claim 1, said clearance means comprising recess means extending in the direction of movement of said shearing member into said slot.

3. Apparatus as set forth in claim 1, said clearance means being provided between said shearing member and said slot on both sides of said shearing member.

4. In an apparatus for crimping a connecting device onto each of two wires to electrically connect said wires to each other, said connecting device being of the open-U type having sidewalls which are adapted to be formed inwardly towards each other and into surrounding relationship with said wires, said apparatus being of the type comprising crimping die means and crimping anvil means, said die and anvil means being movable relatively towards and away from each other between open and closed positions, said anvil means having a supporting surface for supporting said connecting device with said sidewalls directed generally towards said die means, said die means having forming surface portions which are opposed to said anvil means, said forming surface portions comprising front and rear concave trough-like recesses intersecting to form a central cusp, said forming surfaces being adapted to form said sidewalls towards each other and into surrounding relationship to wires extending parallel to said cusp located between said die and anvil, a wire receiving slot in said die means extending transversely therein and intersecting said forming surface portions whereby wires can be positioned between said die and anvil means and can extend laterally through said slot intermediate the ends of said die means, the improvement to said apparatus comprising:

a wire shearing member affixed to said anvil means at the rear of said anvil means and spaced above said anvil means, said shearing member being movable into and out of said slot, said shearing member being dimensioned to snugly fit into a rear fractional portion of said slot whereby a wire placed near the rear of said slot will be severed upon movement of said shearing member into said slot and a wire placed near the front of said slot will not be severed upon movement of said shearing member into said slot and upon movement of said die and anvil means into said closed position, said open U-type connector can be crimped into surrounding relationship with severed and continuous unsevered wires.

5. In an apparatus for crimping a connecting device onto each of two wires to electrically connect said wires to each other, said connecting device being of the open-U type having sidewalls which are adapted to be formed inwardly towards each other and into surrounding relationship with said wires, said apparatus being of the type comprising crimping die means and crimping anvil means, said die and anvil means being movable relatively towards and away from each other between open and closed positions, said anvil means having a supporting surface for supporting said connecting device with said sidewalls directed generally towards said die means, said die means having forming surface portions which are opposed to said anvil means, said forming surface portions comprising front and rear concave troughlike recesses intersecting to form a central cusp, said forming surfaces being adapted to form said sidewalls towards each other and into surrounding relationship to wires extending parallel to said cusp located between said die and anvil, a wirereceiving slot in said die means extending transversely therein and intersecting said forming surface portions whereby wires can be positioned between said die and anvil means and can extend laterally through said slot intermediate the ends of said die means, a wire shearing member positioned between said die and anvil when said die and anvil are in said open position, the maximum width of said shearing member being substantially equal to and less than the width of said slot, said shearing member being movable relatively into said slot to shear wires extending into said slot the improvement to said apparatus comprising:

wire clearance means between said shearing member and one side of said slot, said clearance means extending over a fractional portion of said shearing member, said clearance means extending generally in the direction of movement of said shearing member into said slot, whereby a wire placed in said slot at a point spaced from said clearance means will be severed upon movement of said shearing member into said slot and a wire placed in said clearance means will not be severed upon movement of said shearing member into said slot and upon movement of said die and anvil means into said closed position, said open U-type connector can be crimped into surrounding relationship with severed and continuous unsevered wires.

6. Apparatus as set forth in claim 5 wherein clearance means are located on both sides of said shearing member, and each of said clearance means are located wholly on one side of said cusp so that wires can be simultaneously and independently inserted into said apparatus from opposite sides and said wires may be either severed or not severed depending upon placement of said wires without or within said clearance means respectively.

7. Apparatus as set forth in claim 6 having wire locating means having wire gripping means on both sides of said cusp so that a wire extending parallel to said cusp may be located in gripping means adjacent to the desired portion of said shearing member.

8. Apparatus as set forth in claim 6 having wire retaining means for securing the end of a wire which is not located in said clearance means so that said wire may be located on the side of said cusp adjacent to said retaining means.

9. Apparatus as set forth in claim 8 wherein said wire retaining means comprises a relatively sharp edge over which said wire may be dressed.

* * * * *